US010294646B2

(12) United States Patent
Liu et al.

(10) Patent No.: US 10,294,646 B2
(45) Date of Patent: May 21, 2019

(54) FLUSHING STRUCTURE OF TOILET AND TOILET

(71) Applicant: XIAMEN R&T PLUMBING TECHNOLOGY CO., LTD., Fujian (CN)

(72) Inventors: Ziguang Liu, Fujian (CN); Zhijun Zhong, Fujian (CN)

(73) Assignee: XIAMEN R&T PLUMBING TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 15/838,704

(22) Filed: Dec. 12, 2017

(65) Prior Publication Data

US 2018/0171615 A1 Jun. 21, 2018

(30) Foreign Application Priority Data

Dec. 19, 2016 (CN) ..... 2016 2 1396226 U

(51) Int. Cl.

| | |
|---|---|
| ***E03D 1/26*** | (2006.01) |
| ***E03D 5/02*** | (2006.01) |
| ***E03D 11/02*** | (2006.01) |
| ***E03D 11/18*** | (2006.01) |

(52) U.S. Cl.

CPC ..... *E03D 11/025* (2013.01); *E03D 1/26* (2013.01); *E03D 5/026* (2013.01); *E03D 11/18* (2013.01); *E03D 11/02* (2013.01); *E03D 2201/30* (2013.01); *E03D 2201/40* (2013.01)

(58) Field of Classification Search

CPC ..... E03D 11/025

USPC ..... 4/420–420.5

See application file for complete search history.

(56) References Cited

U.S. PATENT DOCUMENTS

| | | | | | |
|---|---|---|---|---|---|
| 4,996,726 | A * | 3/1991 | Schrock | E03D 1/30 | 137/403 |
| 5,052,060 | A * | 10/1991 | Makita | E03D 5/00 | 137/513.5 |
| 5,109,550 | A * | 5/1992 | Makita | E03D 5/10 | 4/300 |
| 5,204,999 | A * | 4/1993 | Makita | E03D 5/00 | 4/300 |
| 6,145,138 | A * | 11/2000 | Nakamura | E03D 11/02 | 4/420 |
| 2012/0198610 | A1* | 8/2012 | McHale | E03D 11/08 | 4/421 |
| 2017/0130437 | A1* | 5/2017 | Grover | E03D 9/031 | |

* cited by examiner

*Primary Examiner* — Lori L Baker

(74) *Attorney, Agent, or Firm* — Eckert Seamans Cherin & Mellott, LLC; David C. Jenkins

(57) ABSTRACT

A flushing structure of a toilet and a toilet includes a main waterway, a jet waterway and a rim waterway. A main waterway inlet is in communication with an outlet on the toilet tank. A main waterway outlet is in communication with a jet waterway inlet and a rim waterway inlet. A jet waterway outlet is in communication with a jet hole beneath a water surface of a first water seal at the bottom of the toilet bowl. A rim waterway outlet is in communication with a rim hole provided on the toilet bowl for flushing the inner wall of the toilet bowl. A second water seal, whose water surface is on the same level with surface of the first water seal, is provided on the rim waterway. The main waterway and the jet waterway are isolated from air via the first water seal and second water seal.

19 Claims, 6 Drawing Sheets

FLUSHING STRUCTURE OF TOILET AND TOILET

RELATED APPLICATION

The present invention application claims the priority right of the Chinese patent application No. 201621396226.9 entitled as "FLUSHING STRUCTURE OF TOILET AND TOILET" such that the full text thereof is cited here as reference.

TECHNICAL FIELD

The present application relates to the technical field of sanitary wares, especially a flushing structure of a toilet and a toilet having the flushing structure.

BACKGROUND ART

In order to save water resources, existing toilets are mostly siphon-type toilets which bring sewage out of the toilet bowl through siphonage formed during water drainage with strong ability of sewage discharge, and they are more water-saving than ordinary wash-down toilets. Flushing structures of existing siphon-type toilets generally comprise a jet waterway to directly eject towards the inlet of the sewage discharge waterway at the bottom of the toilet bowl to assist in formation of siphonage. However, as most jet waterways are in communication with a rim waterway for flushing the inner wall of the toilet bowl, air will enter the jet waterway through the rim waterway, and during water drainage, air in the jet waterway needs to be exhausted first, so as to form siphon-type drainage to speed up drainage. In order to solve the abovementioned problem, in the prior art, there is a solution of providing a check valve between the jet waterway and the rim waterway to prevent air from entering the jet waterway through the rim waterway after drainage. However, the check valve on the toilet has a small mounting space and is difficult to mount, the structure of the toilet is complex and it costs much. There is another technical solution of using separate jet waterway and rim waterways which are not in communication to solve the abovementioned problem. However, such technical solution needs two drain valves to respectively control the on and off states of the jet waterway and rim waterway, two drain valves cost much and ceramic production technology of two separate waterways are complex. Besides, there is also a technical solution of using a water seal structure to prevent air from entering the jet waterway through the rim waterway after drainage. However, most flushing waterways of toilets having a water seal structure have a complex structure, ceramic production technology is also complex, much modification of the inner structure of the toilet is involved, which results in high cost of modification. Moreover, for existing flushing waterways of toilets having a water seal structure in the market, some provide the inlet of the rim waterway nearby the jet hole, or although the inlet of the rim waterway is not provided nearby the jet hole, there is no enough upward section between the jet hole and the inlet of the rim waterway, such that during flushing, polluted water nearby the jet hole will be flushed into the rim waterway and flow out of a rim hole, causing a problem of secondary pollution of the toilet bowl or even blocking of the rim hole by sewage.

CONTENT OF THE APPLICATION

In order to solve at least one of the abovementioned problems, the present application provides a flushing structure of a toilet and a toilet, which may rapidly facilitate formation of siphonage of the toilet. The flushing structure may also prevent sewage nearby the jet hole from flowing into the rim waterway and causing a problem of secondary pollution of the toilet bowl.

To achieve the above purpose, the application adopts the following technical solution: A flushing structure of a toilet comprises a main waterway, a jet waterway and a rim waterway. An inlet of the main waterway is in communication with an outlet of a toilet tank. An outlet of the main waterway is in communication with an inlet of the jet waterway and an inlet of the rim waterway. An outlet of the jet waterway is in communication with a jet hole beneath a water surface of a first water seal at the bottom of the toilet bowl. An outlet of the rim waterway is in communication with a rim hole provided on the toilet bowl for flushing the inner wall of the toilet bowl. A second water seal, whose surface is on the same level with surface of the first water seal, is provided on the rim waterway. The main waterway and the jet waterway are isolated from air via the first water seal and second water seal.

Further, an upward section, which prevents sewage nearby the jet hole from being flushed into the rim waterway, is provided between the outlet of the jet waterway and the inlet of the rim waterway.

Further, the outlet of the main waterway, the inlet of the jet waterway and the inlet of the rim waterway are all at the rear of the toilet bowl, the rim waterway and the jet waterway extend from the rear of the toilet bowl along the left and right sides of the toilet bowl, respectively.

Further, the inlet of the jet waterway is higher than the outlet of the jet waterway, the jet waterway extends downwards and obliquely from the outlet of the main waterway along a wall surface of the toilet bowl and gradually turns to extend to the jet hole, the portion on the jet waterway that extends downwards and obliquely forms the upward section; the rim waterway extends downwards and obliquely from the outlet of the main waterway along the wall surface of the toilet bowl and turns to extend upwards to form the second water seal.

Further, the outlet of the jet waterway extends upwards from the outlet of the main waterway along the wall surface of the toilet bowl, and gradually turns to extend downwards and obliquely, and gradually turns to extend to the jet hole, the portion on the jet waterway that extends downwards and obliquely forms the upward section; the rim waterway extends downwards and obliquely from the outlet of the main waterway along the wall surface of the toilet bowl and turns to extend upwards to form the second water seal.

Further, the outlet of the main waterway, the inlet of the jet waterway and the inlet of the rim waterway are all above the water surfaces of the first water seal and second water seal.

Further, the rim waterway and the jet waterway extend from corresponding inlet to corresponding outlet respectively.

Further, pipe diameters of the rim waterway and the jet waterway are smaller than a pipe diameter of the main waterway, and the pipe diameter of the rim waterway is smaller than that of the jet waterway.

Further, the flushing structure further comprises a rim channel provided on the top of the toilet bowl, the rim holes are provided on the rim channel and separated each other, the outlet of the rim waterway is in communication with the rim channel, such that water of the rim waterway flows to the rim channel and flows out of the rim holes on the rim channel downwards to flush the inner wall of the toilet bowl.

Further, the rim hole is provided on the inner wall of the toilet bowl, such that water of the rim waterway flows out of the rim hole and forms whirly waterflow to flush the inner wall of the toilet bowl.

Further, the flushing structure further comprises an overflow waterway in communication with an overflow pipe in the toilet tank, and an outlet of the overflow waterway is in communication with the rim waterway at downstream of the second water seal.

Further, the rim waterway extends downwards and obliquely from the outlet of the main waterway along the wall surface of the toilet bowl and turns to extend upwards to form the second water seal.

The present application has the following advantageous effects over the background art:

The present application provides a second water seal, whose surface is on the same level with surface of the first water seal at the bottom of the toilet bowl, on the rim waterway, and the main waterway and the jet waterway are isolated from air by two water seals, such that, when a drainage unit, which can open and close the outlet of the toilet tank, does not drain water, the main waterway and jet waterway of the toilet are full of water or substantially full of water after multiple drainage cycles. That is to say, prestored water forms in the main waterway and the jet waterway. When the drainage unit drains water, the prestored water in the main waterway and the jet waterway can speed up formation of siphonage of the toilet. Moreover, an upward section, which can prevent sewage nearby the jet hole from being flushed into the rim waterway, is provided between the outlet of the jet waterway and the inlet of the rim waterway, so as to avoid the problems of secondary pollution of the toilet bowl and blocking of the rim hole, which is more healthy and reliable.

Besides, the outlet of the main waterway, the inlet of the jet waterway and the inlet of the rim waterway are provided at the rear of the toilet bowl, such that the rim waterway and the jet waterway extend from the rear of the toilet bowl along the left and right sides of the toilet bowl, respectively. Such flushing structure is easy to form and the structure is simple. Moreover, costs of modifications based on existing toilets are low, waterflow is smooth and flushing effect is great.

BRIEF DESCRIPTION OF THE DRAWINGS

Drawings herein are used to provide further understanding of the present application, which constitute a portion of the present application. The schematic embodiments and description of the present application are used for explaining the present utility, and do not constitute improper delimitations of the present application. In the drawings.

EMBODIMENTS

Figure 1:
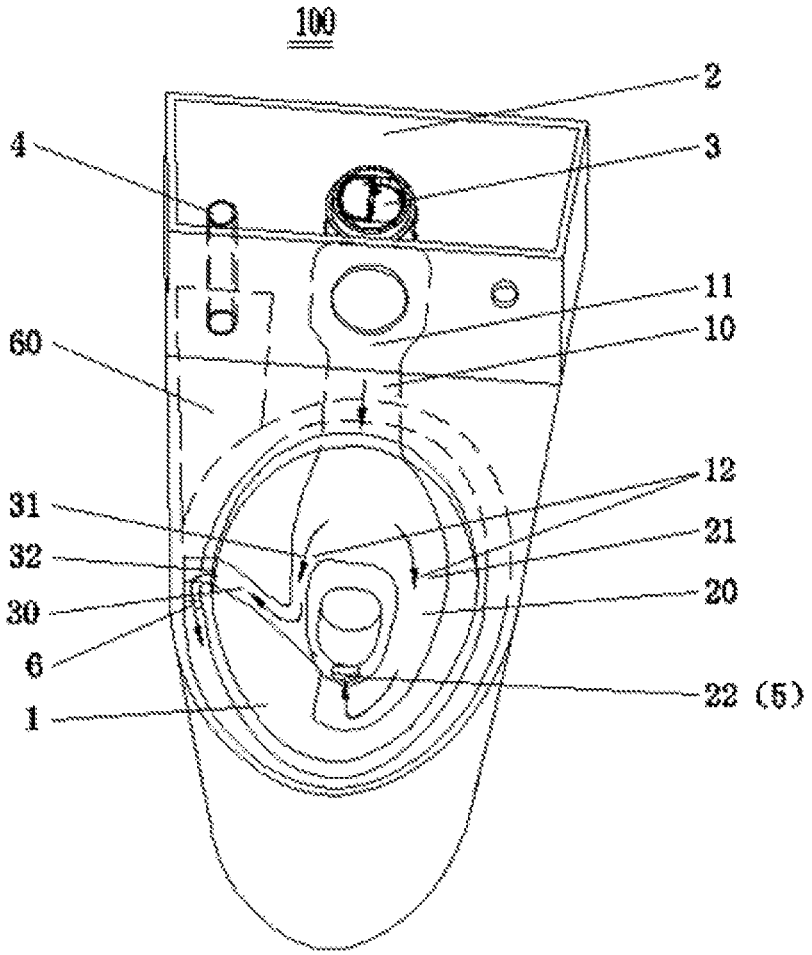
FIG. 1 is a schematic view of the three-dimensional structure of an embodiment of the present application.
Figure 2:
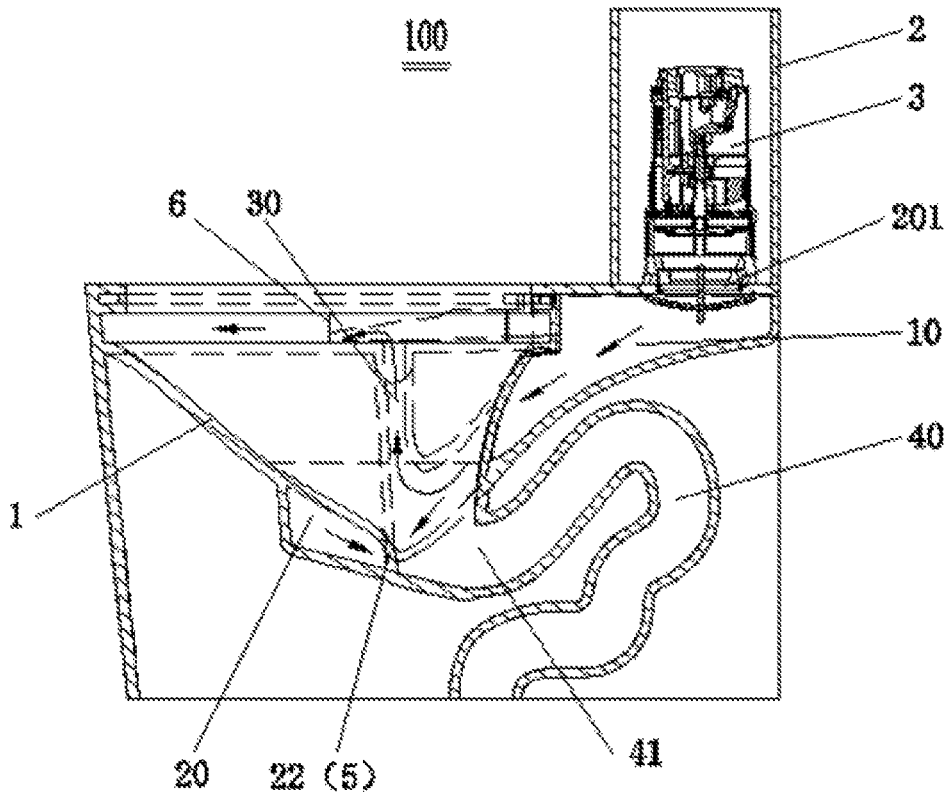
FIG. 2 is a schematic view of the sectional structure of an embodiment of the present application.
Figure 3:
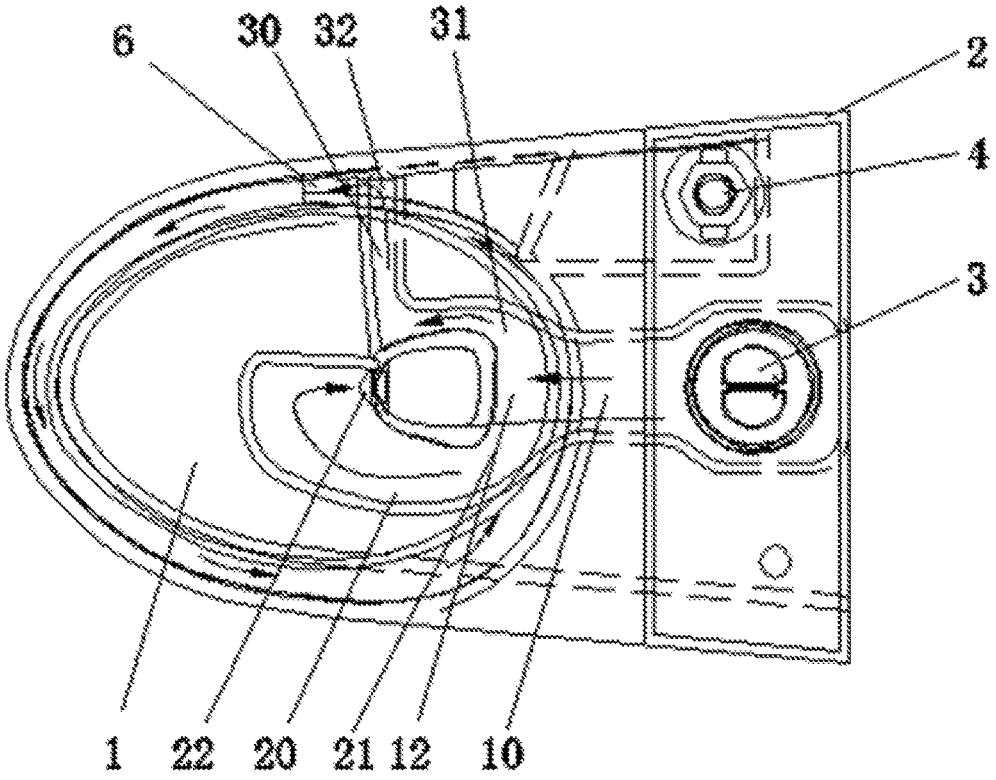
FIG. 3 is a schematic top view of the toilet of an embodiment of the present application.
Figure 4:
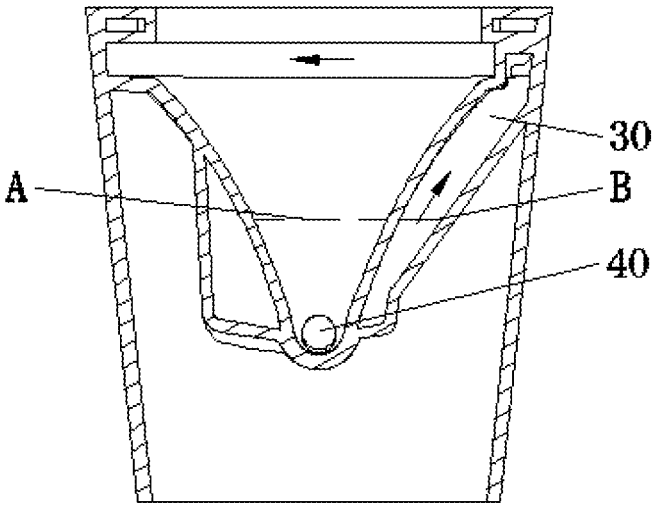
FIG. 4 is another sectional view of an embodiment of the present application.

FIGS. 1-6 show a flushing structure of a toilet 100 of a preferred embodiment of the present application. The flushing structure comprises a main waterway 10, a jet waterway 20 and a rim waterway 30. An inlet 11 of the main waterway is in communication with an outlet 201 of a toilet tank 2. A drainage element 3 is provided at the outlet 201 to control opening and closing of the outlet 201. An outlet 12 of the main waterway is in communication with an inlet 21 of the jet waterway and an inlet 31 of the rim waterway. An outlet 22 of the jet waterway is in communication with a jet hole 5 beneath a water surface of a first water seal A at the bottom of the toilet bowl 1. An outlet 32 of the rim waterway is in communication with a rim hole 6 provided on the toilet bowl 1 for flushing the inner wall of the toilet bowl 1. A second water seal B, whose surface is on the same level with surface of the first water seal A, is provided on the rim waterway 30. The main waterway 10 and the jet waterway 20 are isolated from air via the first water seal A and second water seal B, such that prestored water forms in both the main waterway 10 and the jet waterway 20 after multiple drainage cycles. The prestored water may speed up drainage, so as to rapidly facilitate formation of siphonage of the toilet 100, which is more water-saving. Moreover, an upward section H, which can prevent sewage nearby the jet hole 5 from being flushed into the rim waterway 30, is provided between the outlet 22 of the jet waterway and the inlet 31 of the rim waterway. "Upward section" here is explained to be directed to the direction from the outlet 22 of the jet waterway towards the inlet 31 of the rim waterway. That is, conversely, for the direction from the inlet 31 of the rim waterway towards the outlet 22 of the jet waterway, the "upward section" would be actually a downward section. For the convenience of description, the present application adopts the term "upward section". The upward section H may have different inclinations and total lengths according to different toilet structures and different sizes of waterways, as long as the upward section H can prevent water nearby the jet hole 5 from being flushed into the rim waterway 30 during flushing, thereby avoiding secondary pollution of the toilet bowl 1, which is more healthy and reliable.

Figure 5:
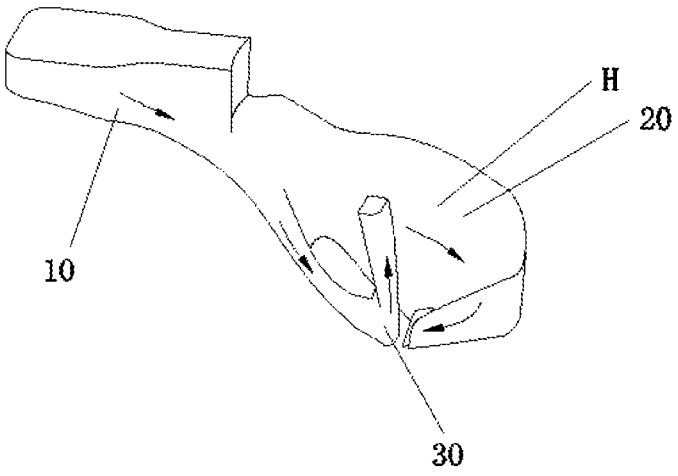
FIG. 5 is an axial view of the waterways of an embodiment of the present application.
Figure 6:
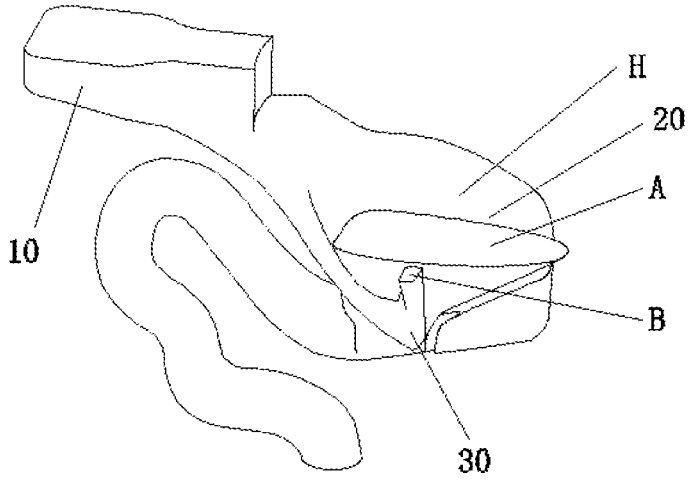
FIG. 6 is a schematic view of the water seals of an embodiment of the present application.

The outlet 12 of the main waterway, the inlet 21 of the jet waterway and the inlet 31 of the rim waterway coincide with each other. In the present embodiment, preferably, the outlet 12 of the main waterway, the inlet 21 of the jet waterway and the inlet 31 of the rim waterway are all at the rear of the toilet bowl 1. Specifically, the jet hole 5 is in front of the toilet bowl 1 and faces an inlet 41 of a sewage discharge waterway 40 at the rear of the toilet bowl 1. The rim waterway 30 and the jet waterway 20 extend from the rear of the toilet bowl 1 along the left and right sides of the toilet bowl 1, respectively. Such flushing structure is easy to form and the structure is simple. Moreover, costs of modifications based on existing toilets are low, waterflow is smooth and flushing effect is great. As shown by FIGS. 5 and 6, in the present embodiment, the inlet 21 of the jet waterway is higher than the outlet 22 of the jet waterway, the jet waterway 20 extends downwards and obliquely from the outlet 12 of the main waterway and along a wall surface of the toilet bowl 1 and gradually turns to extend to the jet hole 5 after passing the inlet 41 of the sewage discharge waterway 40, such that the portion on the jet waterway 20 that extends downwards and obliquely forms the upward section H, while the rim waterway 30 extends downwards and obliquely from the outlet 12 of the main waterway along the wall surface of the toilet bowl 1 and turns to extend upwards to form the second water seal B. Such arrangement enables the outlet 12 of the main waterway, i.e., the inlet 21 of the jet waterway and the inlet 31 of the rim waterway, to be away from the jet hole 5, i.e., making the length of the upward section H longer, thus further reducing the risk that sewage nearby the jet hole 5 may be flushed into the rim waterway 30.

In the present embodiment, the outlet 12 of the main waterway, the inlet 21 of the jet waterway and the inlet 31 of the rim waterway may be all located above the water surfaces of the first water seal A and second water seal B, which may further enlarge the height of the upward section H between the outlet 22 of the jet waterway and the inlet 31 of the rim waterway, thereby further reducing the risk that sewage nearby the jet hole 5 may be flushed into the rim waterway 30, and the function is more reliable. Certainly, the outlet 12 of the main waterway, the inlet 21 of the jet waterway and the inlet 31 of the rim waterway may also be all located beneath the water surfaces of the first water seal A and second water seal B. The specific position is not restricted.

In the present embodiment, preferably, the rim waterway 30 and the jet waterway 20 extend from corresponding inlet to corresponding outlet independently of each other, which has an advantage that the two waterways do not interfere with each other, thereby making the flushing effect of the rim waterway 30 and the jet waterway 20 more stable.

Preferably, pipe diameters of the rim waterway 30 and the jet waterway 20 are smaller than a pipe diameter of the main waterway 10, and the pipe diameter of the rim waterway 30 is smaller than that of the jet waterway 20. The jet waterway 20 uses much water, mostly for playing a major role of flushing, while the rim waterway 30 uses less water, mostly for cleaning the inner wall of the toilet bowl 1.

In the present embodiment, one said rim hole 6 is provided on the inner wall of the toilet bowl 1. Water of the rim waterway 30 flows out of the rim hole 6 and forms whirly waterflow to flush the inner wall of the toilet bowl 1.

Besides, in order to fit with an overflow pipe 4 which is usually provided in the water tank 2 of an ordinary toilet 100, the flushing structure of a toilet according to the present embodiment further comprises an overflow waterway 60 is in communication with the overflow pipe 4 in the toilet water tank 2. An outlet of the overflow waterway 60 is in communication with the rim waterway 30 at downstream of the second water seal B, such that water of the overflow waterway 60 can flow into the toilet bowl 1 through the rim waterway 30. Moreover, as the outlet of the overflow waterway 60 is in communication with the rim waterway 30 downstream of the second water seal B, air won't flow through the overflow waterway 60 into the main waterway 10 and the jet waterway 20 which need to be isolated from air.

During drainage, the drainage element 3 opens the outlet 201, water inside the water tank 2 flows into the main waterway 10 and is divided into two streams at the outlet 12 of the main waterway. One stream flows from the inlet 21 of the jet waterway into the jet waterway 20 and ejected out of the outlet 22 of the jet waterway to assist in formation of siphonage of the sewage discharge waterway 40. The other stream flows from the inlet 31 of the rim waterway into the rim waterway 30 and flows out of the outlet 31 of the rim waterway after flowing through the second water seal B to clean the inner wall of the toilet bowl 1. The waterway structure of the flushing structure is simple, the ceramic toilet is easy to form, and costs of modifications based on existing toilets are low. Especially, it can prevent sewage nearby the jet hole 5 from being flushed into the rim waterway 30 and rapidly facilitates formation of siphonage of the toilet.

Figure 7:
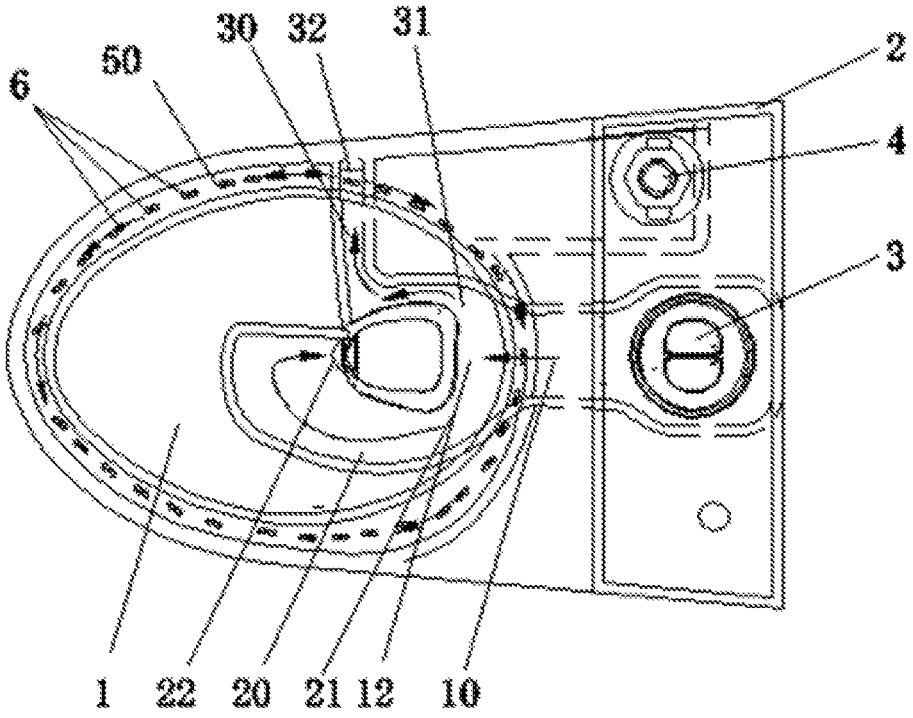
FIG. 7 is a schematic top view of the toilet of another embodiment of the present application.
Figure 8:
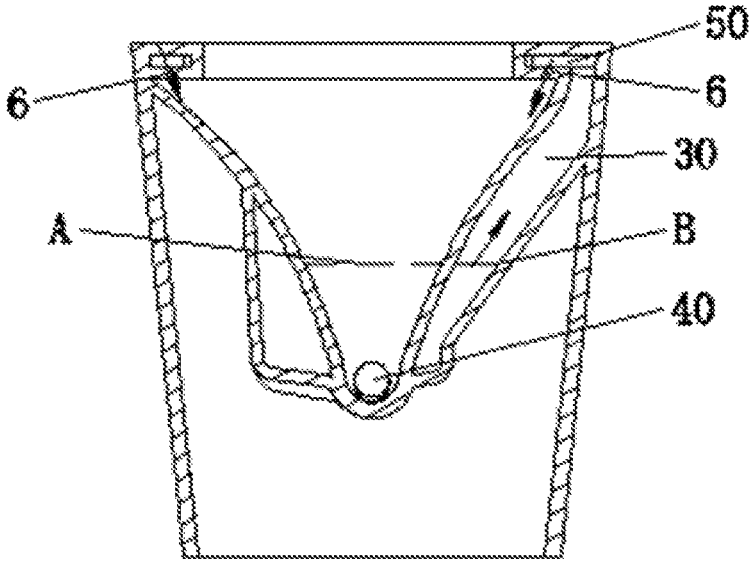
FIG. 8 is a sectional view of the toilet of another embodiment of the present application.

FIGS. 7 and 8 show a flushing structure of a toilet 100 of another preferred embodiment of the present application. This embodiment differs from the aforementioned embodiment in that, according to the present application, water flowing out of the rim hole 6 does not form whirly waterflow to flush the inner wall of the toilet bowl 1, the flushing structure of the present embodiment further comprises a rim channel 50 provided on the top of the toilet bowl, on which a plurality of rim holes 6 are provided and separated each other, an outlet 31 of the rim waterway is in communication with the rim channel 50, water of the rim waterway 30 flows to the rim channel 50 and flows downwards from the rim holes 6 on the rim channel 50 to flush the inner wall of the toilet bowl 1.

The outlet of the overflow waterway 60 is in communication with the rim channel 50. Certainly, the outlet of the overflow waterway 60 may also be in communication with the rim waterway 30 downstream of the second water seal B, as described in the aforementioned embodiment. Choice may be made according to specific requirements.

Figure 9:
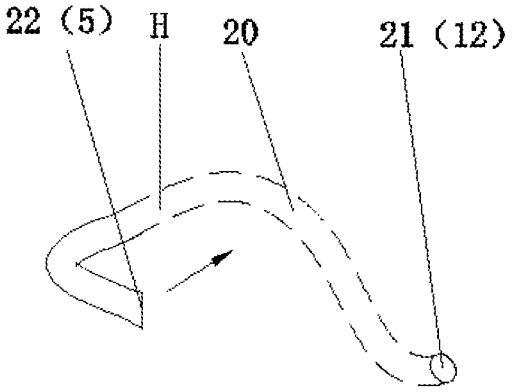
FIG. 9 is a schematic view of the jet waterway of another embodiment of the present application.

FIG. 9 shows a flushing structure of a toilet 100 of another preferred embodiment of the present application. This embodiment differs from the aforementioned embodiment in that, the jet waterway 20 extends upwards from the outlet 12 of the main waterway (i.e., inlet 21 of the jet waterway) along the wall surface of the toilet bowl 1, and gradually turns to extend downwards and obliquely, and gradually turns to extend to the jet hole 5, the portion on the jet waterway 20 that extends downwards and obliquely forms the upward section H. The jet waterway 20 configured in such way can also realize the purpose of the present application, i.e., preventing sewage nearby the jet hole 5 from being flushed into the rim waterway 30. That is, the jet waterway 20 may have different configurations. Maybe as shown by FIGS. 1-8, the outlet 22 of the jet waterway extends upwards and obliquely to the inlet 21 of the jet waterway and the inlet 31 of the rim waterway directly, such that the whole jet waterway 20 is a so-called upward section H. Or maybe as shown by FIG. 9, the jet waterway 20 may extend deviously, such that the upward section H is just part of the jet waterway 20.

It is worth mentioning that, according to the present application, the upward section H between the outlet 22 of the jet waterway and the inlet 31 of the rim waterway may be a complete pipe segment, and of course it may also consist of a plurality of upward pipe segments, for example, when the jet waterway 20 extends deviously in a wave mode, there are a plurality of upward sections between the outlet 22 of the jet waterway and the inlet 31 of the rim waterway, and the plurality of upward sections jointly constitute the upward section H which can prevent sewage nearby the jet hole 5 from being flushed into the rim waterway 30.

The above-mentioned are only principles and preferred embodiments of the present application. It should be pointed out that, for those ordinary people skilled in the art, some other modifications may be made based on the principle of the present application, which should also be regarded as the protection scope of the present application.

What is claimed is:

1. A toilet comprising:

a toilet tank including an outlet;

a toilet bowl;

a flushing structure including a main waterway, a jet waterway, a rim waterway, a first water seal and a second water seal;

an inlet of the main waterway communicating with the outlet of the toilet tank;

an outlet of the main waterway communicating with an inlet of the jet waterway and an inlet of the rim waterway;

an outlet of the jet waterway communicating with a jet hole beneath a surface of the first water seal at the bottom of the toilet bowl;

an outlet of the rim waterway communicating with a rim hole provided on the toilet bowl for flushing the inner wall of the toilet bowl;

the second water seal provided on the rim waterway;

wherein the second water seal surface is on the same level with surface of the first water seal; and wherein the main waterway and the jet waterway being isolated from air via the first water seal and the second water seal.

2. The toilet according to claim 1, wherein an upward section is provided between the outlet of the jet waterway and the inlet of the rim waterway.

3. The toilet according to claim 2, wherein the outlet of the main waterway, the inlet of the jet waterway and the inlet of the rim waterway are all at the rear of the toilet bowl, wherein the rim waterway and the jet waterway extend from the rear of the toilet bowl along the left and right sides of the toilet bowl.

4. The toilet according to claim 3, wherein the inlet of the jet waterway is higher than the outlet of the jet waterway, the jet waterway extends downwards and obliquely from the outlet of the main waterway along a wall surface of the toilet bowl and turns to extend to the jet hole, the portion on the jet waterway that extends downwards and obliquely forms the upward section; the rim waterway extends downwards and obliquely from the outlet of the main waterway along the wall surface of the toilet bowl and turns to extend upwards to form the second water seal.

5. The toilet according to claim 3, wherein the outlet of the jet waterway extends upwards from the outlet of the main waterway along the wall surface of the toilet bowl, and turns to extend downwards and obliquely, and turns to extend to the jet hole, the portion on the jet waterway that extends downwards and obliquely foul's the upward section; the rim waterway extends downwards and obliquely from the outlet of the main waterway along the wall surface of the toilet bowl and turns to extend upwards to form the second water seal.

6. The toilet according to claim 1, wherein the outlet of the main waterway, the inlet of the jet waterway and the inlet of the rim waterway are all above the surfaces of the first water seal and second water seal.

7. The toilet according to claim 1, wherein each of the rim waterway and the jet waterway extend from a corresponding inlet to a corresponding outlet.

8. The toilet according to claim 1, wherein pipe diameters of the rim waterway and the jet waterway are smaller than a pipe diameter of the main waterway, and the pipe diameter of the rim waterway is smaller than that of the jet waterway.

9. The toilet according to claim 1, wherein the flushing structure further comprises a rim channel provided on the top of the toilet bowl, the rim holes are provided on the rim channel and separated each other, the outlet of the rim waterway is in communication with the rim channel, such that water of the rim waterway flows to the rim channel and flows out of the rim holes on the rim channel downwards to flush the inner wall of the toilet bowl.

10. The toilet according to claim 1, wherein the rim hole is provided on the inner wall of the toilet bowl, such that water of the rim waterway flows out of the rim hole and forms waterflow to flush the inner wall of the toilet bowl.

11. The toilet according to claim 1, wherein the flushing structure further comprises an overflow waterway in communication with an overflow pipe in the toilet tank, and an outlet of the overflow waterway is in communication with the rim waterway at downstream of the second water seal.

12. The toilet according to claim 1, wherein the outlet of the main waterway, the inlet of the jet waterway and the inlet of the rim waterway are all at the rear of the toilet bowl, the rim waterway and the jet waterway extend from the rear of the toilet bowl along the left and right sides of the toilet bowl, respectively.

13. The toilet according to claim 1, wherein the rim waterway extends downwards and obliquely from the outlet of the main waterway along the wall surface of the toilet bowl and turns to extend upwards to form the second water seal.

14. The toilet according to claim 2, wherein the rim waterway extends downwards and obliquely from the outlet of the main waterway along the wall surface of the toilet bowl and turns to extend upwards to form the second water seal.

15. The toilet according to claim 12, wherein the rim waterway extends downwards and obliquely from the outlet of the main waterway along the wall surface of the toilet bowl and turns to extend upwards to form the second water seal.

16. The toilet according to claim 2, wherein the inlet of the jet waterway is higher than the outlet of the jet waterway, the jet waterway extends downwards and obliquely from the outlet of the main waterway along a wall surface of the toilet bowl and gradually turns to extend to the jet hole, the portion on the jet waterway that extends downwards and obliquely forms the upward section.

17. The toilet according to claim 2, wherein the outlet of the jet waterway extends upwards from the outlet of the main waterway along the wall surface of the toilet bowl, and gradually turns to extend downwards and obliquely, and gradually turns to extend to the jet hole, the portion on the jet waterway that extends downwards and obliquely forms the upward section.

18. The toilet according to claim 13, wherein the outlet of the main waterway, the inlet of the jet waterway and the inlet of the rim waterway are all above the water surfaces of the first water seal and second water seal.

19. The toilet according to claim 13, wherein each of the rim waterway and the jet waterway extend from a corresponding inlet to a corresponding outlet.

* * * * *